US010974409B2

(12) United States Patent
Pryor et al.

(10) Patent No.: US 10,974,409 B2
(45) Date of Patent: Apr. 13, 2021

(54) CARTRIDGE FOR A FOOD PROCESSING MACHINE

(71) Applicant: Provisur Technologies, Inc., Chicago, IL (US)

(72) Inventors: Glen F. Pryor, Manhattan, IL (US); Gage A. Fox, Manhattan, IL (US); Ryan M. Torrenga, Bourbonnais, IL (US); Ryan J. O'Connor, Clarendon Hills, IL (US); Jeff Schmuker, Country Club Hills, IL (US); Nick Jackowski, Plainfield, IL (US)

(73) Assignee: PROVISUR TECHNOLOGIES, INC., Chicago, IL (US)

( * ) Notice: Subject to any disclaimer, the term of this patent is extended or adjusted under 35 U.S.C. 154(b) by 99 days.

(21) Appl. No.: 16/154,595

(22) Filed: Oct. 8, 2018

(65) Prior Publication Data

US 2020/0108520 A1 Apr. 9, 2020

(51) Int. Cl.

| | |
|---|---|
| ***B26D 7/06*** | (2006.01) |
| ***B26D 5/12*** | (2006.01) |
| ***B26D 7/01*** | (2006.01) |
| ***B26D 7/30*** | (2006.01) |
| ***B26D 7/32*** | (2006.01) |

(52) U.S. Cl.

CPC ..... *B26D 7/0616* (2013.01); *B26D 5/12* (2013.01); *B26D 7/01* (2013.01); *B26D 7/0641* (2013.01); *B26D 7/30* (2013.01); *B26D 7/32* (2013.01); *B26D 2210/02* (2013.01)

(58) Field of Classification Search

CPC ..... B65H 23/08; B65H 23/14; B65H 23/16; B65B 25/001; B65B 25/06; B65B 25/08

See application file for complete search history.

(56) References Cited

U.S. PATENT DOCUMENTS

| | | | |
|---|---|---|---|
| 1,136,089 | A | 4/1915 | Bernheim |
| 2,114,020 | A | 4/1938 | Froney |
| 3,481,746 | A | 12/1969 | Clemens et al. |
| 3,772,040 | A | 11/1973 | Benson et al. |
| 3,889,325 | A | 6/1975 | Fleissner |
| 3,921,803 | A | 11/1975 | Reed et al. |
| 4,583,435 | A | 4/1986 | Fessler |
| 4,736,899 | A | 4/1988 | Murasaki |
| 4,913,049 | A | 4/1990 | Sainio |
| 5,051,268 | A | 9/1991 | Mally |
| 5,121,682 | A | 6/1992 | Parker et al. |
| 5,209,387 | A | 5/1993 | Long et al. |
| 5,611,194 | A | 3/1997 | Wildmoser |

(Continued)

FOREIGN PATENT DOCUMENTS

| | | |
|---|---|---|
| DE | 3230988 | 2/1984 |
| DE | 10011006 | 9/2001 |
| WO | 0176996 | 10/2001 |

OTHER PUBLICATIONS

Supplemental European Search Report (dated Jul. 8, 2010).

(Continued)

*Primary Examiner* — William E Dondero

(74) *Attorney, Agent, or Firm* — Klintworth & Rozenblat IP LLP

(57) ABSTRACT

A cartridge for a food processing machine includes a base member, a stock roller drag brake, a nip roller, and a chute. The stock roller drag brake is rotatably attached to the base member. The nip roller is rotatably attached to the base member. The chute is attached to the base member.

31 Claims, 12 Drawing Sheets

(56) References Cited

U.S. PATENT DOCUMENTS

| | | | |
|---|---|---|---|
| 5,613,530 | A | 3/1997 | Kincel et al. |
| 5,628,237 | A | 5/1997 | Lindee et al. |
| 5,649,463 | A | 7/1997 | Lindee |
| 5,704,265 | A | 1/1998 | Johnson et al. |
| 5,724,874 | A | 3/1998 | Lindee et al. |
| 5,768,959 | A | 6/1998 | Lorenzo |
| 5,954,914 | A | 9/1999 | Aihara |
| 6,079,188 | A | 6/2000 | Katayama et al. |
| 6,153,233 | A | 11/2000 | Gordon et al. |
| 6,305,145 | B2 | 10/2001 | Suolahti |
| 6,408,757 | B2 | 6/2002 | Ogawa et al. |
| 6,484,615 | B2 | 11/2002 | Lindee |
| 6,616,084 | B1 | 9/2003 | Sitzmann |
| 6,698,681 | B1 | 3/2004 | Guy et al. |
| 6,712,112 | B2 | 3/2004 | Goodwin et al. |
| 6,752,056 | B1 | 6/2004 | Weber |
| 9,399,531 | B2 | 7/2016 | Pryor |
| 2003/0089209 | A1 | 5/2003 | Brueckel et al. |
| 2013/0000249 | A1 | 1/2013 | Griggs et al. |
| 2016/0023370 | A1 | 1/2016 | Muller |

OTHER PUBLICATIONS

International Search Report and Written Opinion for PCT Application No. PCT/US19/52010 dated Dec. 5, 2019, 18 pages.
Notice of Opposition EP06817369 (Sep. 5, 2012).
Evidence Cited in Notice of Opposition EP06817369 (Sep. 5, 2012).
Patent Document Citations in Notice of Opposition EP06817369 (Sep. 5, 2012).
EPO Communication Re Notice of Opposition in EPEP06817369 (Sep. 18, 2012).
EPO Communication to File Observations in Opposition EPEP06817369 (Oct. 12, 2012).
EPO Notice to Opponents in Opposition EPEP06817369 (Oct. 12, 2012).
International Search Report (dated Sep. 5, 2008), PCT/US06/41616, 3 pages.
Supplemental European Search Report (dated Jul. 8, 2010), EP 06 81 7369, 5 pages.
Extended European Search Report for EP 06817369.9-2308, dated Jul. 19, 2010, 8 pages.
Transalation of Notice of Opposition EP06817369 documents, 34 pages.

CARTRIDGE FOR A FOOD PROCESSING MACHINE

FIELD OF THE DISCLOSURE

This disclosure relates to a cartridge for a food processing machine, such as a for a slicing food processing machine.

BACKGROUND

Food processing machines are used to process food such as to slice, weigh, classify, and package food products. Food processing machines are sometimes used to dispose stock, such as paper or film, underneath a food product, and to subsequently slice the food product and the underlying stock. However, these food processing machines often utilize a complicated assembly of separate components to achieve this task. The separate components are typically not easily adjustable to accommodate a varied number and/or position of stock rollers unspooling the stock to meet the food processing needs.

A food processing machine, and method of its use, is needed to overcome one or more of the issues associated with one or more of the existing food processing machines.

SUMMARY

In one embodiment, a cartridge for a food processing machine is disclosed. The cartridge includes a base member, a stock roller drag brake, a nip roller, and a chute. The stock roller drag brake is rotatably attached to the base member. The nip roller is rotatably attached to the base member. The chute is attached to the base member.

In one embodiment, a food processing machine is disclosed. The food processing machine includes a frame, a stock roller, a feed roller, and a cartridge. The stock roller is rotatably connected with the frame, and configured to unspool stock. The feed roller is rotatably connected with the frame, and configured to feed the unspooled stock. The cartridge includes a base member, a stock roller drag brake, a nip roller, and a chute. The base member is connected with the frame. The stock roller drag brake is rotatably attached to the base member, and is configured to apply a braking force to the stock roller. The nip roller rotatably is attached to the base member, and is configured to apply a nip force to the feed roller. The chute is attached to the base member, and is configured to direct the fed, unspooled stock from the feed roller along a path of the chute.

In another embodiment, a method of operating a food processing machine is disclosed. One step comprises attaching a cartridge to a frame. The cartridge includes a base member, a stock roller drag brake rotatably attached to the base member, a nip roller rotatably attached to the base member, and a chute attached to the base member. Another step comprises unspooling stock from a stock roller as the stock roller drag brake applies a braking force to the stock roller. An additional step comprises feeding the unspooled stock between the feed roller and a nip roller as the nip roller applies a nip force to the feed roller. Yet another step comprises directing the fed, unspooled stock from the feed roller along a path of the chute.

The scope of the present disclosure is defined solely by the appended claims and is not affected by the statements within this summary.

BRIEF DESCRIPTION OF THE DRAWINGS

The disclosure can be better understood with reference to the following drawings and description. The components in the figures are not necessarily to scale, emphasis instead being placed upon illustrating the principles of the disclosure.

DETAILED DESCRIPTION

Figure 1:
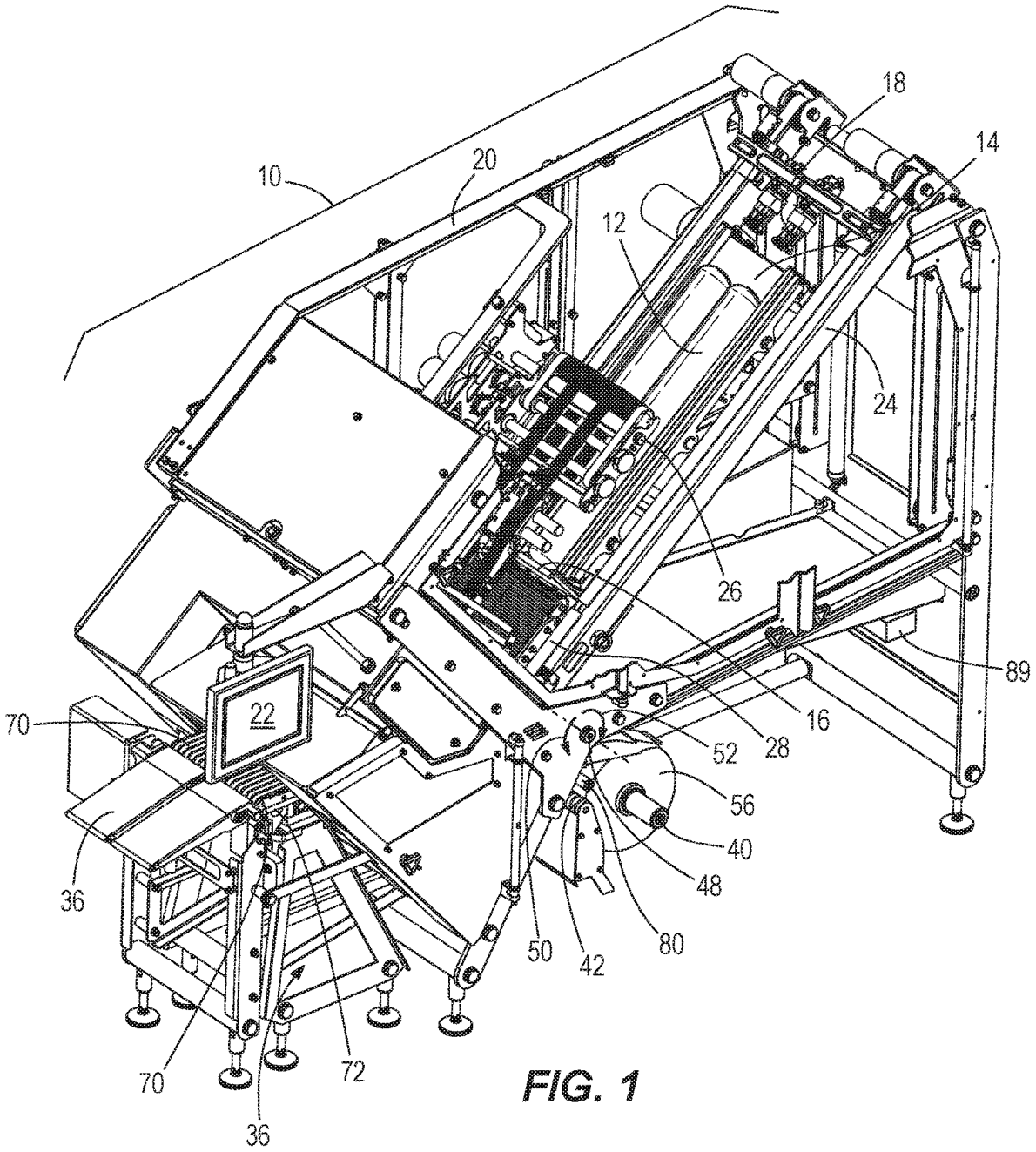
FIG. 1 illustrates a side perspective view of one embodiment of a food processing machine with a food product disposed in a product tray in a raised position, held in place by a gate, with a gripper device disposed apart from the food product.
Figure 2:
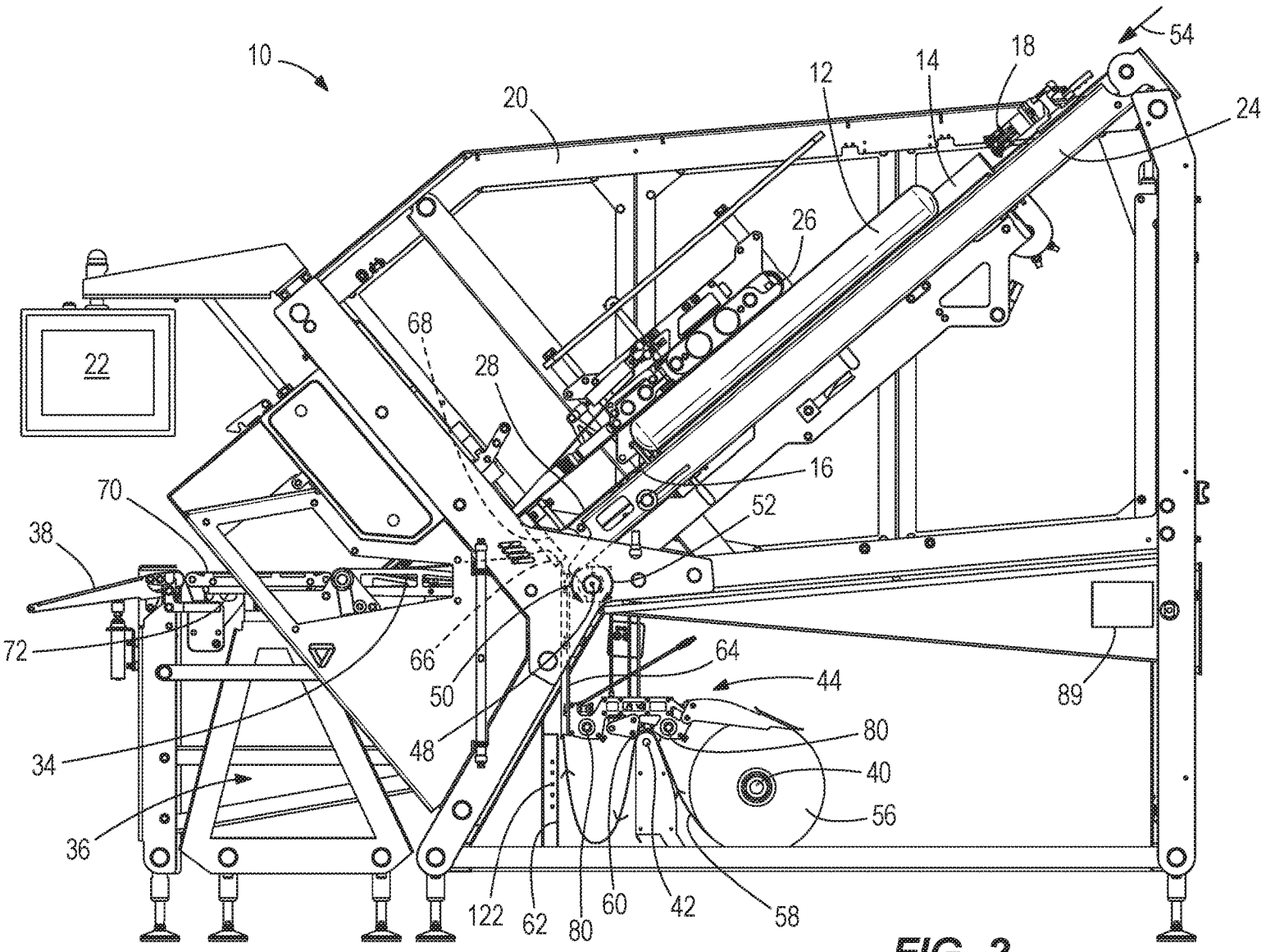
FIG. 2 illustrates a side view of the food processing machine of the embodiment of FIG. 1 with the food product disposed in the product tray in the raised position, held in place by the gate, with the gripper device disposed apart from the food product.
Figure 3:
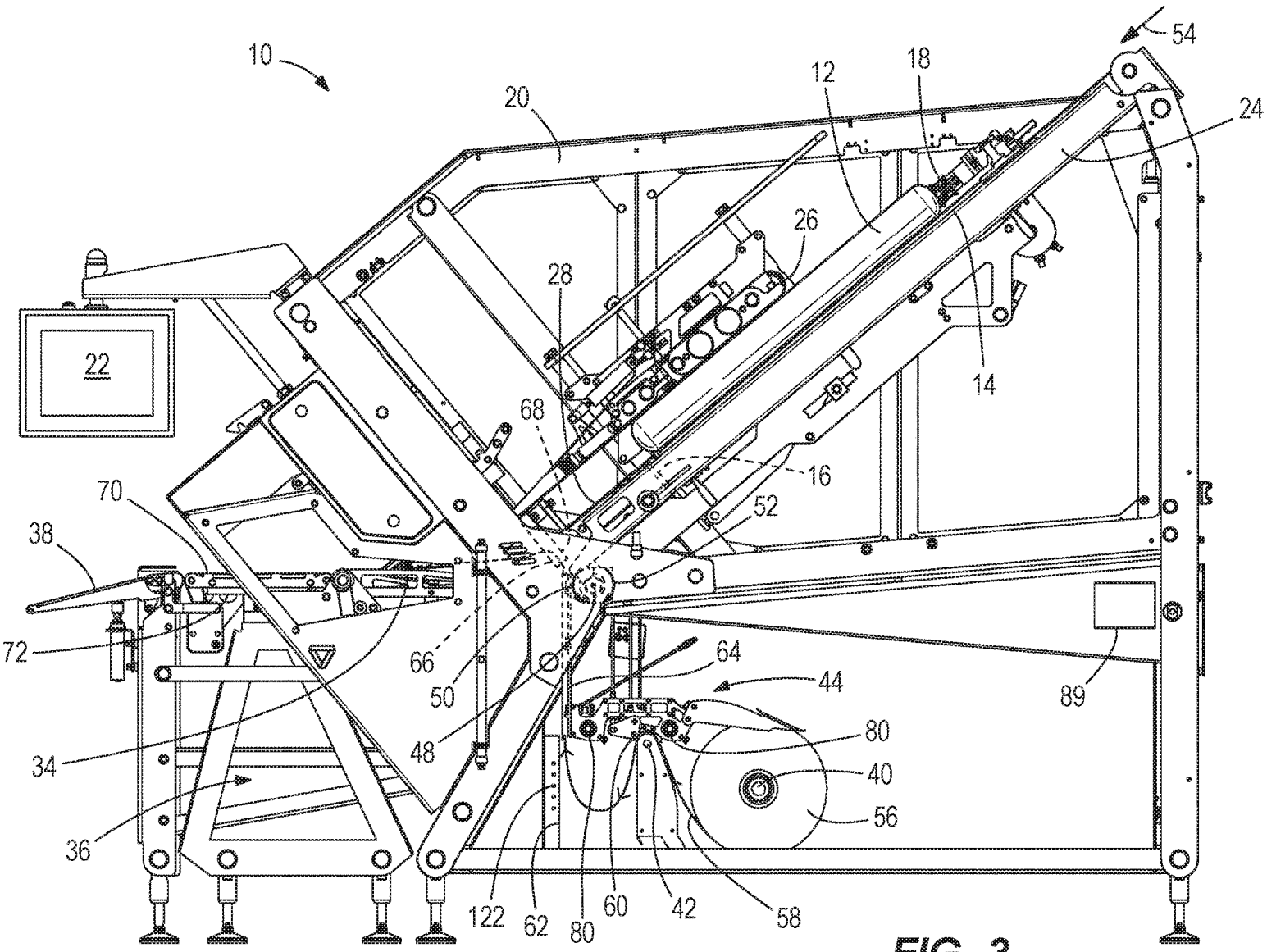
FIG. 3 illustrates a side view of the food processing machine of the embodiment of FIG. 1 with the food product disposed in the product tray in the raised position, with the gate having been lowered away from the food product, with the gripper device disposed against an end of the food product holding the food product in place.
Figure 4:
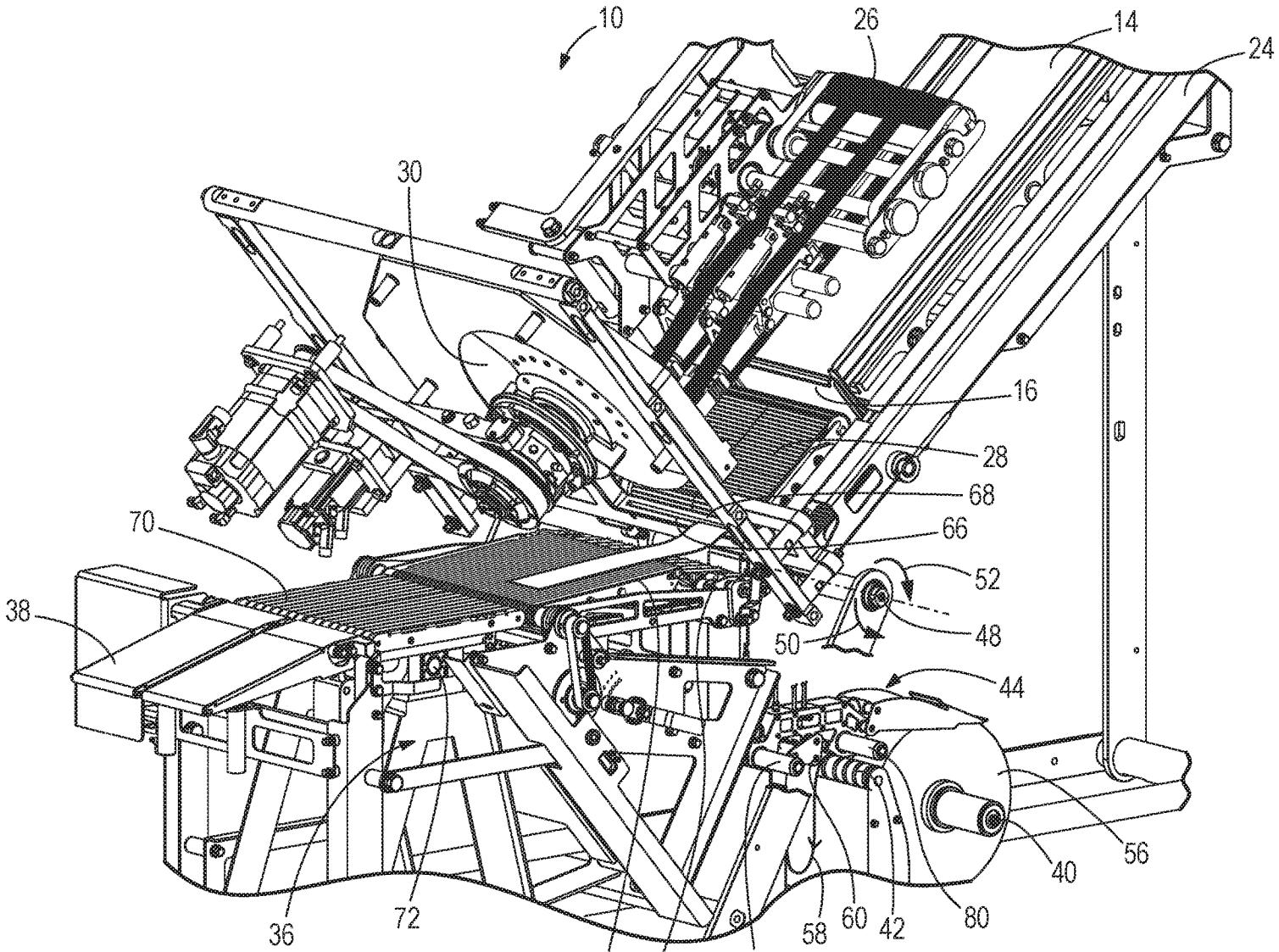
FIG. 4 illustrates a partial side perspective view of the food processing machine of the embodiment of FIG. 1 with a portion of a frame of the food processing machine of FIG. 1 removed and the food product removed to assist in viewing internal components.
Figure 5:
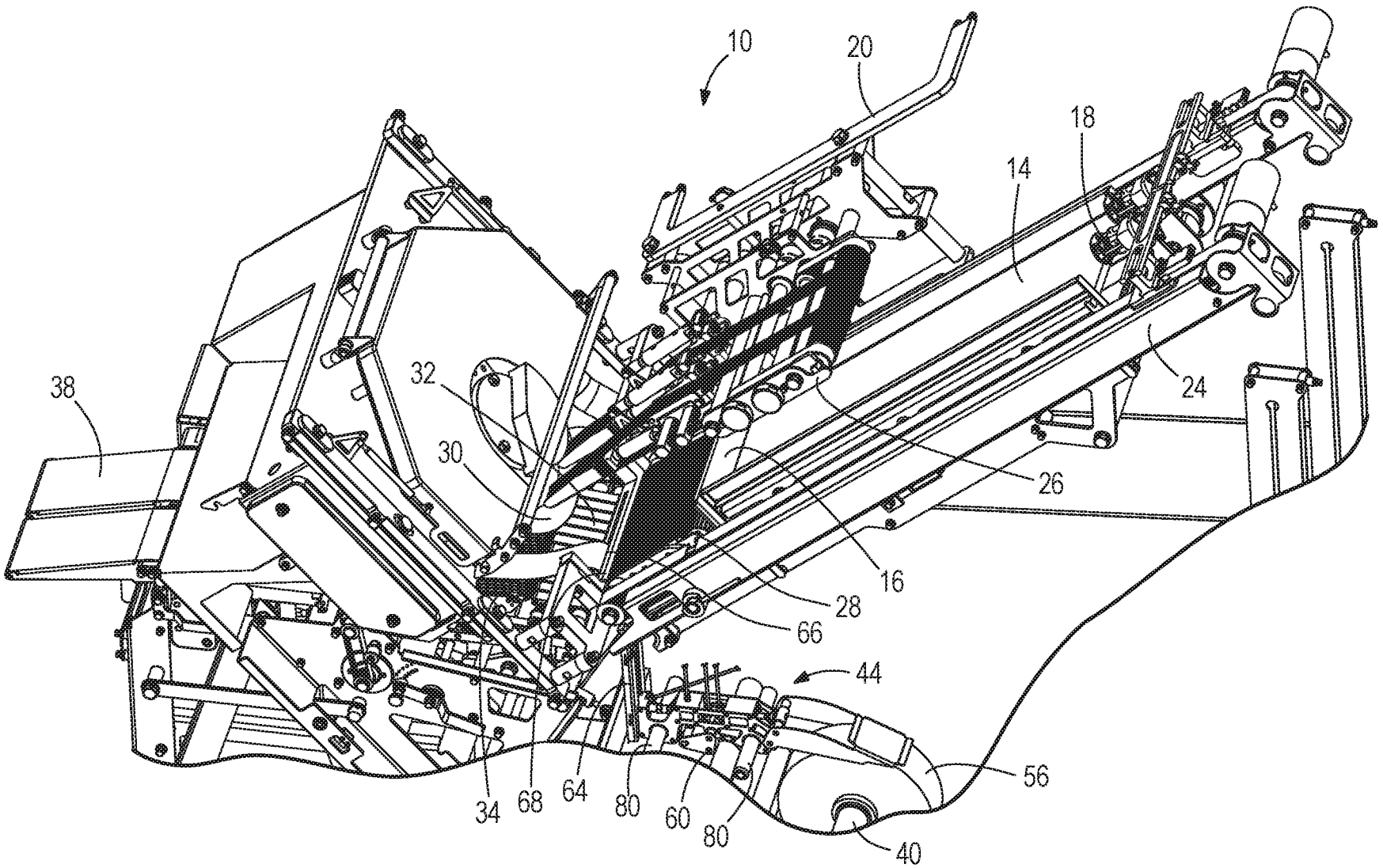
FIG. 5 illustrates a top partial perspective view of the food processing machine of the embodiment of FIG. 1 with the portion of the frame of the food processing machine of FIG. 1 removed and the food product removed to assist in viewing internal components.

FIG. 1 illustrates a side perspective view of one embodiment of a food processing machine 10 with a food product 12 disposed in a product tray 14 in a raised position, held in place by a gate 16, with a gripper device 18 disposed apart from the food product 12. FIG. 2 illustrates a side view of the food processing machine 10 of the embodiment of FIG. 1 with the food product 12 disposed in the product tray 14 in the raised position, held in place by the gate 16, with the gripper device 18 disposed apart from the food product 12. FIG. 3 illustrates a side view of the food processing machine 10 of the embodiment of FIG. 1 with the food product 12 disposed in the product tray 14 in the raised position, with the gate 16 having been lowered away from the food product 12, with the gripper device 18 disposed against an end of the food product 12 holding the food product 12 in place. FIG. 4 illustrates a partial side perspective view of the food processing machine 10 of the embodiment of FIG. 1 with a portion 19 of a frame 20 of the food processing machine 10 of FIG. 1 removed and the food product 12 removed to assist in viewing internal components. FIG. 5 illustrates a top partial perspective view of the food processing machine 10 of the embodiment of FIG. 1 with the portion 19 of the frame 20 of the food processing machine 10 of FIG. 1 removed and the food product 12 removed to assist in viewing internal components.

As shown collectively in FIGS. 1-5, the food processing machine 10 in part comprises the product tray 14, the gate 16, the gripper device 18, the frame 20, a control system 22, a product tray lift 24, an upper infeed 26, a lower infeed 28, a slicing device 30, a slicing conveyor 32, a transfer conveyor 34, an exposed load cell device 36, a classifier device 38, a stock roller 40, a feed roller 42, and a cartridge 44.

The control system 22, comprising at least one processor in communication with at least one memory containing processing code, is adapted to control the entire food processing machine 10 including all of its components identified herein. As such, all movements or actions of any components of the food processing machine 10 described herein are controlled by the control system 22. The product tray lift 24 is adapted to automatically rotate around pivot point 48 in counter-clockwise and clockwise directions 50 and 52 in order to respectfully raise and lower the product tray 14. It is noted that for purposes of this disclosure the term "automatically" means that one or more motors, controlled by the control system 22, are used to achieve the movement. Initially, the food product 12 is loaded in the product tray 14 while the product tray lift 24 has the product tray 14 disposed in a horizontal position (not shown) with the gate 16 holding the food product 12 in the product tray 14. After the food product 12 is loaded in the product tray 14, the product tray lift 24 is automatically rotated in counter-clockwise direction 50 to dispose the product tray 14, the gate 16, and the food product 12 held within the product tray 14 by the gate 16 in the position of FIG. 2. Next, the gripper device 18 is automatically moved from its raised position apart from the food product 12 as shown in FIG. 2 in direction 54 to a lowered position against an end of the food product 12 as shown in FIG. 3 at which time the gripper device 18 is used to grip an end of the food product 12. Subsequently, the gate 16 is automatically moved away from its position against the food product 12 as shown in FIG. 2 to its lowered position as shown in FIG. 3 so that the gate 16 no longer blocks the food product 12 from moving out of the product tray 14.

Next, the upper infeed 26 is automatically rotated clockwise 52 and the lower infeed 28 is automatically rotated counter-clockwise 50 while the gripper device 18 is automatically moved further in direction 54 to gradually move the food product 12 into the slicing device 30. Simultaneously, the stock roller 40 is automatically rotated clockwise 52 to unspool stock 56 from the stock roller 40, and the feed roller 42 is automatically rotated counter-clockwise 50 to feed the unspooled stock 56. It is noted that the stock roller 40 and the feed roller 42 are both rotatably connected with the frame 20 of the food processing machine 10. The stock 56 may comprise a backing surface such as paper or film. The unspooled stock 56 automatically follows path 58 to advance from the stock roller 40, between the feed roller 42 and a nip roller 60 of cartridge 44, along a vacuum plate 62, through a chute 64 of the cartridge 44, through slot 66 in shear bar 68, and into a path of the slicing device 30 where it is disposed underneath and against the food product 12.

The slicing device 30 simultaneously automatically slices the food product 12 and the unspooled stock 56, disposed underneath and below the food product 12, which then together fall onto the slicing conveyor 32 which is located directly underneath the slicing device 30. At this time, the sliced food product 12 is disposed against and on top of the sliced unspooled stock 56 which is disposed against and on top of the slicing conveyor 32. The slicing conveyor 32 automatically rotates counter-clockwise 50 to move the sliced food product 12 disposed on top of the sliced unspooled stock 56 to and onto the transfer conveyor 34. The transfer conveyor 34 automatically rotates counter-clockwise to move the sliced food product 12 disposed on top of the sliced unspooled stock 56 to and onto an exposed load cell conveyor 70 of the exposed load cell device 36.

The exposed load cell 72 of the exposed load cell device 36 automatically weighs the sliced food product 12 disposed against and on top of the sliced unspooled stock 56. The exposed load cell conveyor 70 of the exposed load cell device 36 then automatically moves the weighed and sliced food product 12, disposed against and on top of the sliced unspooled stock 56, to and onto the classifier device 38. The classifier device 38 automatically classifies the weighed and sliced food product 12 by determining whether the weighed and sliced food product 12 meets an acceptable criteria in part based on the determined weight of the weighed and sliced food product 12, as determined by the exposed load cell device 36. The weighed and sliced food product 12, disposed against and on top of the sliced unspooled stock 56, which is determined by the classifier device 38 to meet the acceptable criteria is then packaged. The weighed and sliced food product 12, disposed against and on top of the sliced unspooled stock 56, which is determined by the classifier device to not meet the acceptable criteria is then discarded or used for other purposes.

Figure 6:
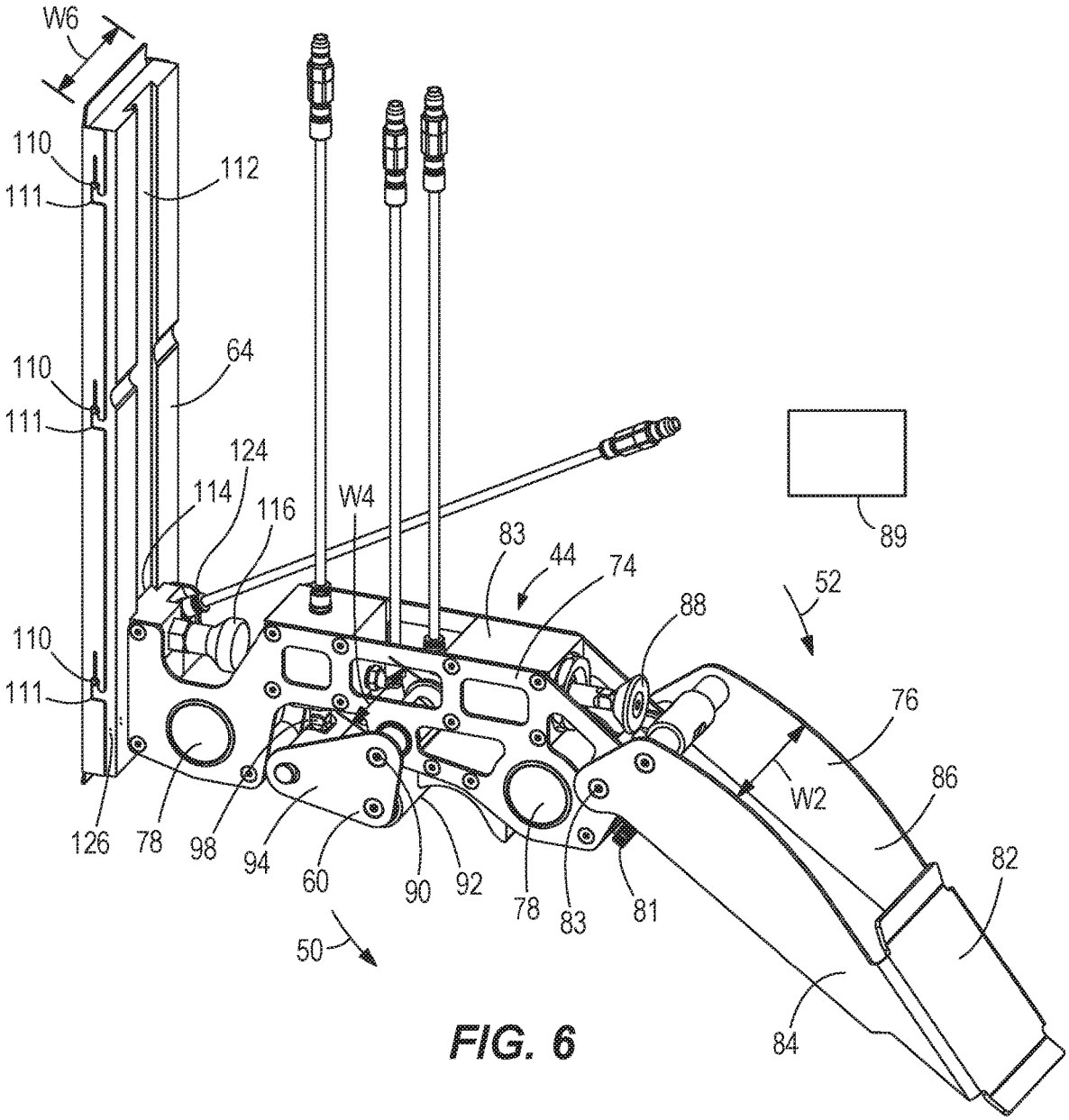
FIG. 6 illustrates a perspective view of a cartridge of the food processing machine of the embodiment of FIGS. 1-5 removed from the food processing machine.
Figure 7:
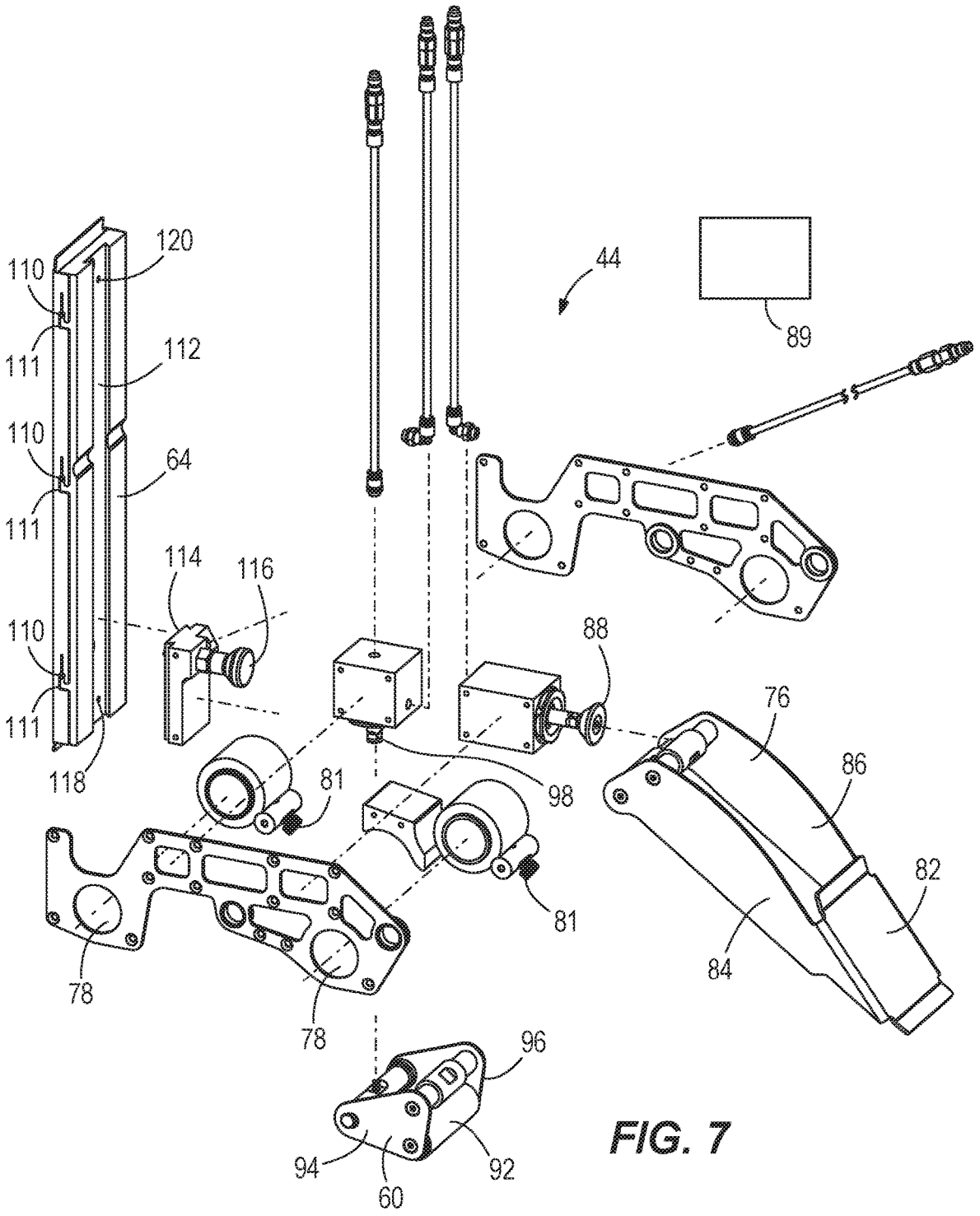
FIG. 7 illustrates a perspective, disassembled view of the cartridge of FIG. 6.

FIG. 6 illustrates a perspective view of the cartridge 44 of the food processing machine 10 of the embodiment of FIGS. 1-5 removed from the food processing machine. FIG. 7 illustrates a perspective, disassembled view of the cartridge 44 of FIG. 6.

As shown collectively in FIGS. 1-7, the cartridge 44 comprises a base member 74, a stock roller drag brake 76, the nip roller 60, and the chute 64. The base member 74 comprises a plurality of female attachment shafts 78 which are configured to slide over a plurality of male shafts 80 of the frame 20 of the food processing machine 10 to attach the base member 74 to the frame 20. The base member 74 further comprises a plurality of locking members 81 which are configured to selectively lock and unlock the base member 74 to and from the plurality of male shafts 80. The plurality of locking members 81 allow the base member 74 to be moved to and locked at a desired location relative to the plurality of male shafts 80, and allow the base member 74 to be subsequently repositioned by unlocking the plurality of unlocking members 81, moving the base member 74 to a second position relative to the plurality of male shafts 80, and relocking the plurality of locking members 81 at the second position. The plurality of locking members 81 comprise locking screws. In other embodiments, the plurality of locking members 81 may vary.

The stock roller drag brake 76 is rotatably attached to the base member 74 with a pin 83. The stock roller drag brake 76 comprises a top surface 82 and opposed side surfaces 84 and 86 extending perpendicularly from the top surface 82. The stock roller 40 is disposed within and between the opposed side surfaces 84 and 86 of the stock roller 40. The opposed side surfaces 84 and 86 force the stock roller 40 to be centered relative to the base member 74 of the cartridge 44. A pneumatic cylinder 88 of the cartridge 44 is configured to rotate the stock roller drag brake 76 in clockwise direction 52 relative to the base member 74 so that the top surface 82 of the stock roller drag brake 76 applies a braking force to and against the stock roller 40 so that the stock 56 from the stock roller 40 is unspooled at a regulated rate. The pneumatic cylinder 88 is driven by a pneumatic manifold 89.

The nip roller 60 is rotatably attached to the base member 74 with a pin 90. The nip roller 60 comprises a roller 92 rotatably disposed between opposed side surfaces 94 and 96. A pneumatic cylinder 98 of the cartridge 44 is configured to rotate the nip roller 60 in counter-clockwise direction 50 relative to the base member 74 so that the roller 92 applies a nip force to the stock 56 and the feed roller 42 as the stock 56 feeds to and between the roller 92 and the feed roller 42 along the path 58. The pneumatic cylinder 98 of the cartridge 44 is also configured to rotate the nip roller 60 in clockwise direction 52 relative to the base member 74 so that the roller 92 applies less of a nip force to the stock 56 and the feed roller 42 as the stock 56 feeds to and between the roller 92 and the feed roller 42 along the path 58. The pneumatic cylinder 98 is driven by the pneumatic manifold 89. In such manner, a variable amount of nip force may be applied by the nip roller 60 to the stock 56 and the feed roller 42 as the stock 56 feeds to and between the roller 92 and the feed roller 42 along the path 58.

Figure 8:
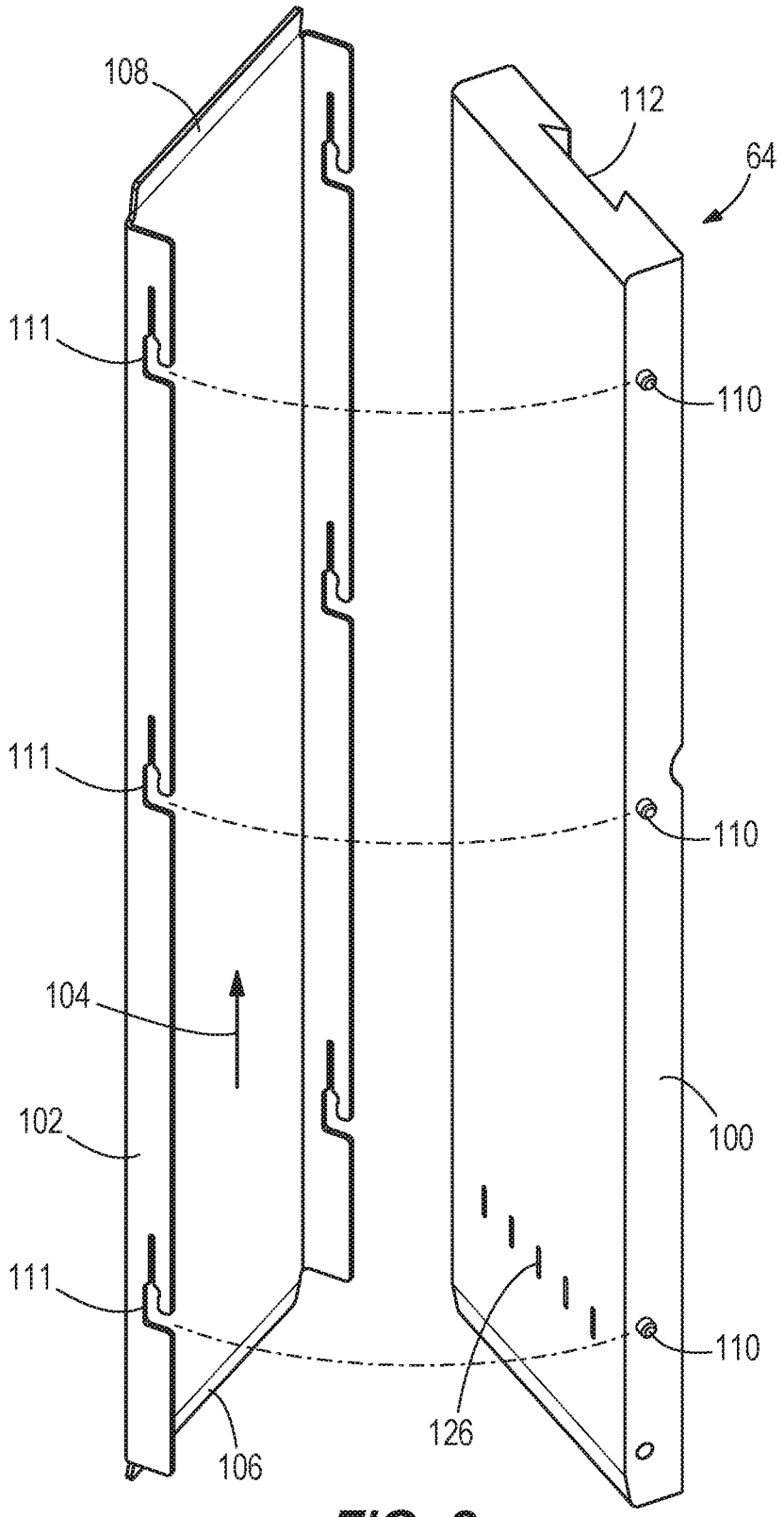
FIG. 8 illustrates a perspective disassembled view of a chute removed from the cartridge of the embodiment of FIG. 6.
Figure 9:
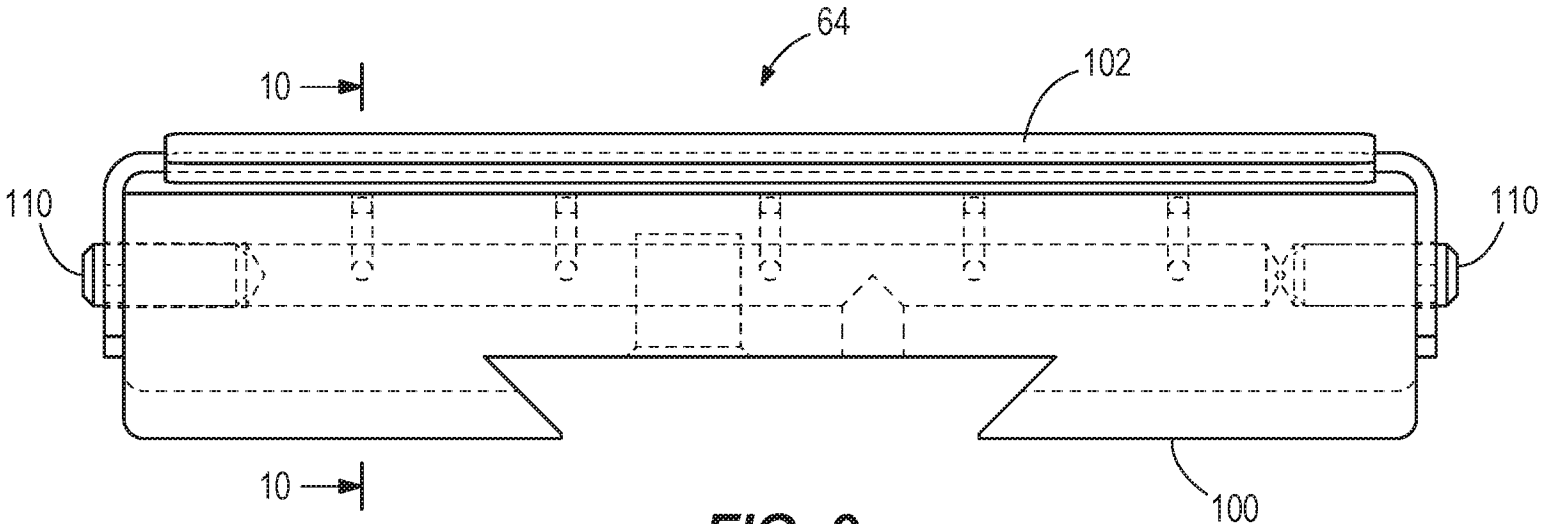
FIG. 9 illustrates an end view of the chute of the embodiment of FIG. 8.
Figure 10:
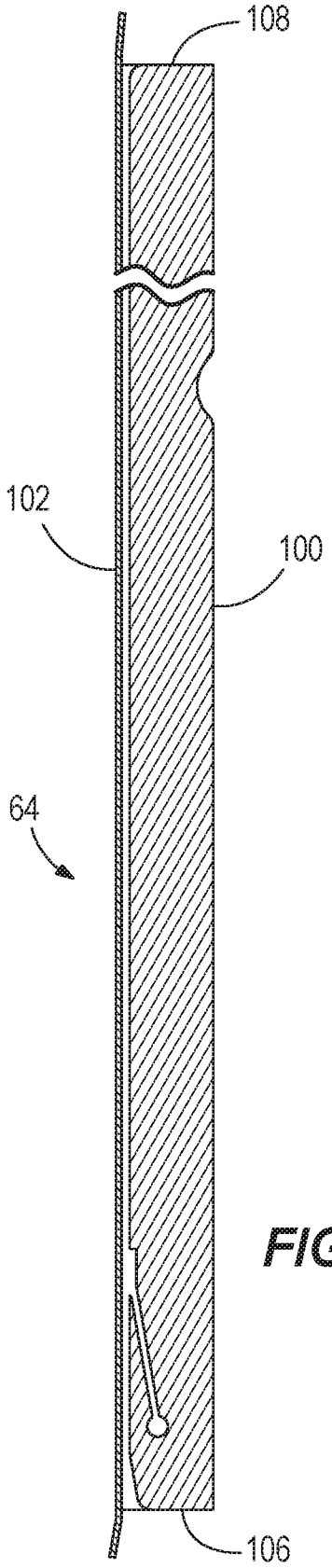
FIG. 10 illustrates a cross-sectional view along a longitudinal axis of the chute.

FIG. 8 illustrates a perspective disassembled view of the chute 64 removed from the cartridge 44 of the embodiment of FIG. 6. FIG. 9 illustrates an end view of the chute 64 of the embodiment of FIG. 8. FIG. 10 illustrates a cross-sectional view along a longitudinal axis of the chute 64.

As shown collectively in FIGS. 1-10, the chute 64 comprises a chute body 100 and a chute cover 102. An interior channel 104 is disposed between the chute body 100 and the chute cover 102. The interior channel 104 extends between open opposed ends 106 and 108 of the chute 64. The chute cover 102 is selectively locked to and unlocked from the chute body 100 with locking elements 110 and 111 which allow the chute cover 102 to be removed from the chute body 100 to clean the interior channel 104 of the chute 64. The locking elements 110 and 11 comprises mating pins and grooves. In other embodiments, the locking elements 110 and 111 may vary. The chute body 100 comprises a mating element 112 which mates with a mating element 114 of the cartridge 44. The mating element 112 comprises a female mating element comprising a groove and the mating element 114 comprises a male mating element comprising a stud. The mating element 114 is configured to slide relative to the mating element 112 to remove the chute body 100 from the cartridge 44. The base member 74 of the cartridge 44 comprises a locking member 116 configured to selectively mate with either of mating members 118 and 120 of the chute body 100. The locking member 116 comprises a locking bolt and the mating members 118 and 120 comprise holes. The chute body 100 can be selectively locked in different positions relative to the cartridge 44 by locking the locking member 116 to either the mating member 118 to dispose the chute body 100 in one position relative to the cartridge 44 or by locking the locking member 116 to mating member 120 to dispose the chute body 100 in a second position relative to the cartridge 44.

The vacuum plate 62 comprises a plurality of holes 122. Negative air pressure sucks the fed, unspooled stock 56 against the vacuum plate 62, as the fed, unspooled stock 56 follows the path 58, prior to the fed, unspooled stock 56 entering the interior channel 104 of the chute 64. Pneumatic air, supplied by the pneumatic manifold 89, flows through a pneumatic air fitting 124 of the base member 74, through the interior channel 104 of the chute 64, through at least one exit hole 126, and out of the interior channel 104. This air pressure sucks the fed, unspooled stock 56 along the path 58 from the vacuum plate 62, through the interior channel 104 of the chute 64, through slot 66 in shear bar 68, and into a path of the slicing device 30 where it is disposed underneath and against the food product 12.

Figure 11:
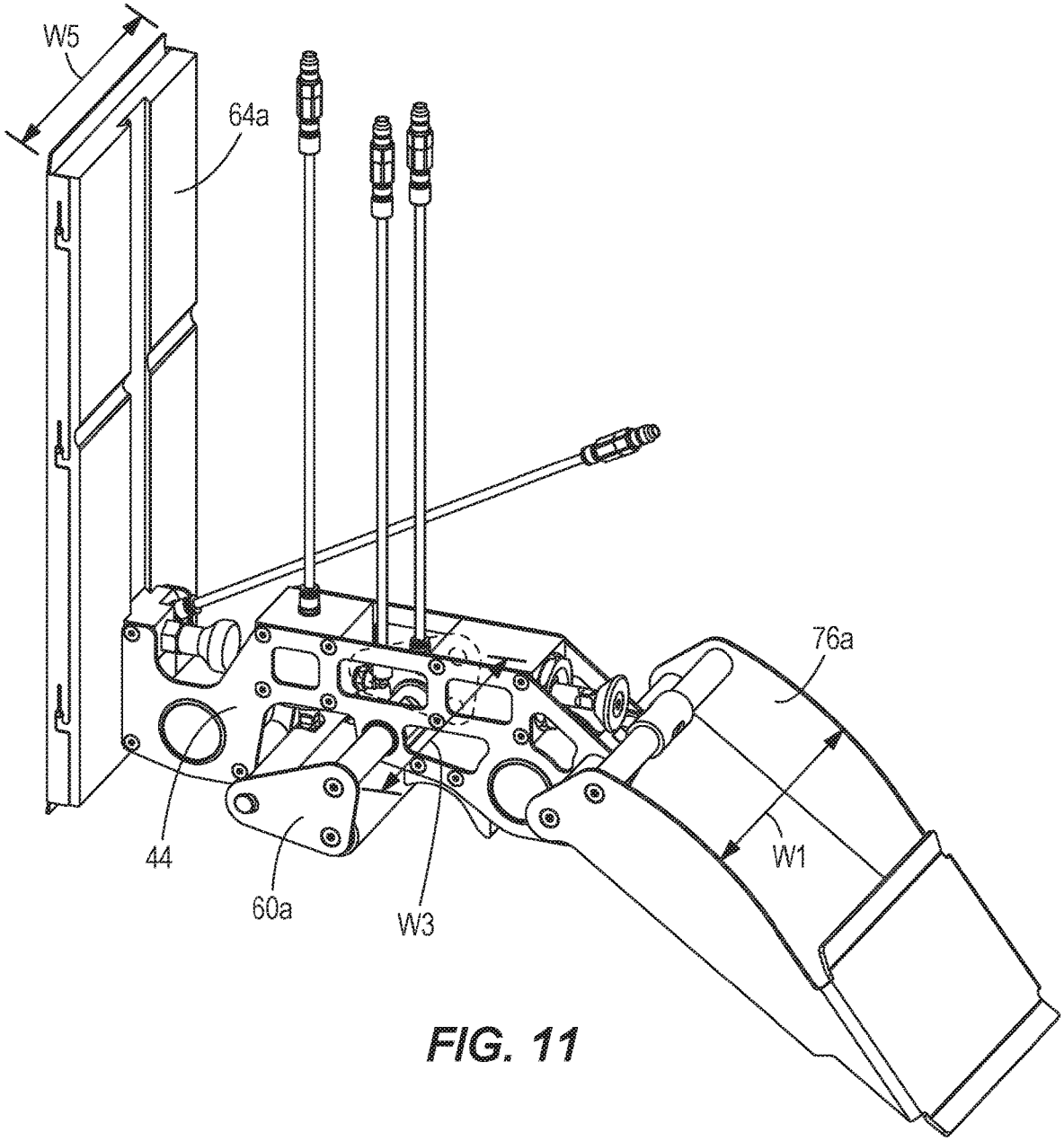
FIG. 11 illustrates a kit that can be attached to the cartridge in place of the kit attached to the cartridge in the food processing machine of the embodiment of FIG. 1.

The stock roller drag brake 76, the nip roller 60, and the chute 64 of FIG. 6 comprise a first kit which are each configured to be selectively detached from and reattached to the base member 74 of the cartridge 44. FIG. 11 illustrates a second kit, comprising a second stock roller drag brake 76*a*, a second nip roller 60*a*, and a second chute 64*a*, attached to the cartridge 44 in place of the first kit. The second stock roller drag brake 76*a* had a different width W1 than the width W2 of the first stock roller drag brake 76. The second nip roller 60*a* has a different width W3 than the width W4 of the nip roller 60. The second chute 64*a* has a different width W5 than the width W6 of the chute 64. By attaching a varied kit having differing widths to the cartridge 44, a differing sized stock roller 40 can be centered relative to the cartridge 44 with the differing sized second stock roller drag brake 76*a*, and the stock 56 of the differing sized second stock roller 40 can be unspooled and fed along the path 58 created by the differing sized second nip roller 60*a* and second chute 64*a*.

By simultaneously and adjustably attaching/securing a plurality of cartridges 44 to the plurality of male shafts 80 of the frame 20 of the food processing machine 10, a plurality of stock rollers 40 can be simultaneously accommodated by the food processing machine 10 to unspool and feed their stock 56 along a plurality of spaced-apart paths/lanes 58 created by the plurality of cartridges 44. In such manner, the adjustably spaced cartridges 44 allow for a great deal of flexibility to simultaneously accommodate a plurality of stock rollers 40 located in different positions within the food processing machine 10.

Moreover, by simultaneously and adjustably attaching/securing a plurality of cartridges 44 to the plurality of male shafts 80 of the frame 20 of the food processing machine 10, with each of the plurality of cartridges 44 attached to differing sized kits, varied sized stock rollers 40 can be simultaneously accommodated by the food processing machine 10 to unspool and feed their differing sized stock 56 along a plurality of spaced-apart paths/lanes 58 created by the differing sized kits. In such manner, the adjustably spaced cartridge(s) 44 and kits allow for a great deal of flexibility to simultaneously accommodate a plurality of varied size stock rollers 40 located in different positions within the food processing machine 10.

Figure 12:
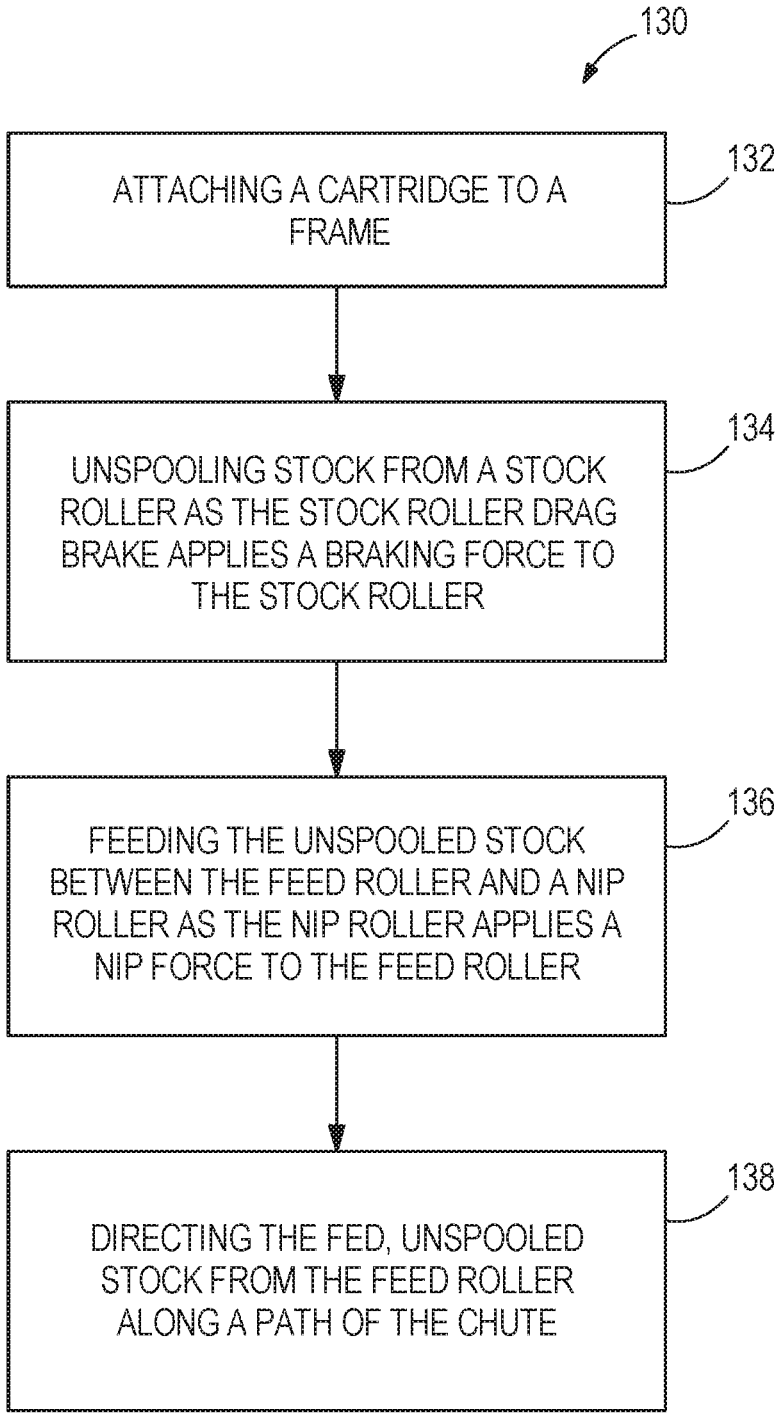
FIG. 12 illustrates a flowchart illustrating one embodiment of a method of operating a food processing machine.

FIG. 12 illustrates a flowchart illustrating one embodiment of a method 130 of operating a food processing machine. The method 130 may utilize any of the food-processing machines and/or cartridges of the disclosure. Step 132 comprises attaching a cartridge to a frame. The cartridge may comprise a base member, a stock roller drag brake rotatably attached to the base member, a nip roller rotatably attached to the base member, and a chute attached to the base member. In one embodiment, step 132 may comprise inserting a plurality of male shafts of the frame through a plurality of female attachment shafts of the base member, and locking the base member to the plurality of male shafts with a plurality of locking members. In another embodiment, step 132 may further comprise selectively unlocking the plurality of locking members, moving the base member along the plurality of base members to a different position, and relocking the base member to the plurality of male shafts at the different position using the plurality of locking members.

Step 134 comprises unspooling stock from a stock roller as the stock roller drag brake applies a braking force to the stock roller. In one embodiment, step 134 comprises the stock roller being disposed within and between opposed side surfaces of the stock roller drag brake, and a top surface of the stock roller drag brake, disposed perpendicularly to the opposed side surfaces, applying the braking force to the stock roller. In another embodiment, step 134 comprises a pneumatic cylinder rotating the stock roller drag brake relative to the base member to apply the braking force to the stock roller. Step 136 comprises feeding the unspooled stock between the feed roller and a nip roller as the nip roller applies a nip force to the feed roller. In one embodiment, step 136 comprises a pneumatic cylinder rotating the nip roller relative to the base member to apply the nip force to the feed roller. Step 138 comprises directing the fed, unspooled stock from the feed roller along a path of the chute. In one embodiment, step 138 comprises air entering a pneumatic fitting aligned with an interior channel, defining the path, of the chute to cause the fed, unspooled stock to move along the path of the chute.

In other embodiments, one or more steps of the method 130 may be altered in substance or in order, one or more steps of the method 130 may not be followed, or one or more additional steps may be added to the method 130 in any order.

For instance, in one embodiment the method 130 may further comprise a step of locking the chute to the base member with a locking member. In another embodiment, the method 130 may further comprise a step of unlocking the chute from the base member, changing a position of the chute relative to the base member, and relocking the chute to the base member with the locking member. In another embodiment, the method 130 may further comprise a step of air exiting at least one air hole aligned with the interior channel of the chute to cause the fed, unspooled stock to move along the path of the chute. In still another embodiment, the method 130 may further comprise a step of detaching the chute from the base member, detaching a chute cover from a chute body of the chute, washing the interior channel of the chute, reattaching the chute to the chute body, and reattaching the chute to the base member.

In still another embodiment, the method 130 may further comprise a step of detaching a first kit, comprising the stock roller drag brake, the nip roller, and the chute, from the base member. In still another embodiment, the method 130 may further comprise a step of attaching a second kit, comprising a second stock roller drag brake, a second nip roller, and a second chute, to the base member in place of the first kit, wherein the second stock roller drag brake has a different first width than the stock roller drag brake, the second nip roller has a different second width than the nip roller, and the second chute has a different third width than the chute. In still another embodiment, the method 130 may further comprise a step of attaching a plurality of the cartridges to the frame, and using the plurality of the cartridges to unspool, feed, and direct a plurality of the stock from a plurality of the stock roller, between the feed roller and a plurality of the nip roller, and along a plurality of the path of the plurality of the chute.

The disclosure may provide one or more of the following benefits over one or more of the prior food-processing machines: (1) self-contained stock guiding within the cartridge; (2) a self-contained pneumatic stock roller drag brake which keeps the stock from over-feeding from the stock roller; (3) the stock roller drag brake guides the stock due to its opposed sides captivating the stock roller; (4) a self-contained pneumatic nip feed roller for stock feeding from the stock roller; (5) a self-contained chute that guides the stock through the slot of the shear bar; (6) a self-contained air pressure design for feeding the stock into the chute; (7) the chute slides down from the cartridge without the necessity of tools for easy removal and subsequent washing; (8) the chute can be easily disassembled for cleaning of an interior channel of the chute; (9) the cartridge design allows for adding or subtracting cartridges to or from the food processing machine depending on the food processing needs in regards to how many lanes of product need to be run; (10) infinite adjustment of the cartridge lanes from side to side in the food processing machine may be made to accommodate the food processing needs; (11) different widths of stock can be easily accommodated due to the cartridge design; and (12) all of the above features are self-contained within the cartridge to make the feeding of the stock much simpler with better results.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true scope of the subject matter described herein. Furthermore, it is to be understood that the disclosure is defined by the appended claims. Accordingly, the disclosure is not to be restricted except in light of the appended claims and their equivalents.

The invention claimed is:

1. A cartridge for a food processing machine comprising:
- a base member;
- a stock roller drag brake rotatably attached to the base member;
- a nip roller rotatably attached to the base member; and
- a chute attached to the base member;
- wherein the cartridge is attachable and detachable from the food processing machine.

2. The cartridge of claim 1 wherein the base member comprises a plurality of female attachment shafts.

3. The cartridge of claim 2 wherein the base member comprises a plurality of locking members oriented in alignment with the plurality of female attachment shafts.

4. The cartridge of claim 1 wherein the stock roller drag brake comprises a top surface and opposed side surfaces extending perpendicularly from the top surface.

5. The cartridge of claim 1 further comprising a pneumatic cylinder configured to rotate the stock roller drag brake relative to the base member.

6. The cartridge of claim 1 further comprising a pneumatic cylinder configured to rotate the nip roller relative to the base member.

7. The cartridge of claim 1 further comprising a locking member configured to selectively lock and unlock the chute from the base member.

8. The cartridge of claim 7 wherein the chute comprises a plurality of mating members which are each configured to selectively mate with the locking member to adjustably change an attached position of the chute relative to the base member.

9. The cartridge of claim 1 wherein the base member further comprises a pneumatic air fitting aligned with an interior channel of the chute.

10. The cartridge of claim 9 wherein the chute further comprises at least one air exit hole aligned with the interior channel of the chute.

11. The cartridge of claim 1 wherein the chute comprises a chute body and a chute cover, wherein the chute cover is detachably attached to the chute body, and the chute cover and the chute body define an interior channel extending through the chute.

12. The cartridge of claim 1 wherein the stock roller drag brake, the nip roller, and the chute, comprising a first kit, are each configured to be selectively detached from and reattached to the base member.

13. The cartridge of claim 12 further comprising a second kit comprising a second stock roller drag brake, a second nip roller, and a second chute, wherein the second stock roller drag brake has a different first width than the stock roller drag brake, the second nip roller has a different second width than the nip roller, and the second chute has a different third width than the chute, and the second kit, comprising the second stock roller drag brake, the second nip roller, and the second chute, is configured to be attached to the base member in place of the first kit.

14. A food processing machine comprising:

a frame;

a stock roller rotatably connected with the frame, the stock roller configured to unspool stock;

a feed roller rotatably connected with the frame, the feed roller configured to feed the unspooled stock; and a cartridge comprising a base member connected with the frame, a stock roller drag brake rotatably attached to the base member, a nip roller rotatably attached to the base member, and a chute attached to the base member;

wherein the stock roller drag brake is configured to apply a braking force to the stock roller, the nip roller is configured to apply a nip force to the feed roller, and the chute is configured to direct the fed, unspooled stock from the feed roller along a path of the chute;

wherein the cartridge is attachable and detachable from the food processing machine.

15. The food processing machine of claim 14 wherein the frame comprises a plurality of male shafts, and the base member comprises a plurality of female attachment shafts, wherein the plurality of male shafts are disposed through the plurality of female attachment shafts attaching the base member to the frame.

16. The food processing machine of claim 15 wherein the base member comprises a plurality of locking members locking the base member to the plurality of male shafts, the plurality of locking members configured to selectively lock and unlock the base member to and from the plurality of male shafts to allow the base member to be selectively moved and relocked at different locations relative to and along the plurality of male shafts.

17. The food processing machine of claim 14 wherein the stock roller drag brake comprises a top surface and opposed side surfaces extending perpendicularly from the top surface, and the stock spooled on the stock roller is disposed within and between the opposed side surfaces.

18. The food processing machine of claim 17 wherein the top surface of the stock roller drag brake is in direct contact with the stock spooled on the stock roller.

19. The food processing machine of claim 14 wherein the cartridge further comprises a pneumatic cylinder configured to rotate the stock roller drag brake relative to the base member to apply the braking force to the stock roller.

20. The food processing machine of claim 14 wherein the cartridge further comprises a pneumatic cylinder configured to rotate the nip roller relative to the base member to apply the nip force to the feed roller.

21. The food processing machine of claim 14 wherein the cartridge further comprises a locking member configured to selectively lock and unlock the chute from the base member.

22. The food processing machine of claim 21 wherein the chute further comprises a plurality of mating members which are each configured to selectively mate with the locking member to adjustably change an attached position of the chute relative to the base member.

23. The food processing machine of claim 14 wherein the base member further comprises a pneumatic air fitting aligned with an interior channel, defining the path, of the chute.

24. The food processing machine of claim 23 wherein the chute further comprises at least one air exit hole aligned with the interior channel of the chute.

25. The food processing machine of claim 14 wherein the chute comprises a chute body and a chute cover, wherein the chute cover is detachably attached to the chute body, and the chute cover and the chute body define the interior channel of the chute.

26. The food processing machine of claim 14 wherein the stock roller drag brake, the nip roller, and the chute, comprising a first kit, are each configured to be selectively detached from and reattached to the base member.

27. The food processing machine of claim 26 further comprising a second kit comprising a second stock roller drag brake, a second nip roller, and a second chute, wherein the second stock roller drag brake has a different first width than the stock roller drag brake, the second nip roller has a different second width than the nip roller, and the second chute has a different third width than the chute, and the second kit, comprising the second stock roller drag brake, the second nip roller, and the second chute, is configured to be attached to the base member in place of the first kit.

28. The food processing machine of claim 14 further comprising a moveable product tray, a slicing device, and at least one infeed, wherein the moveable product tray holds a food product and the at least one infeed is configured to move the food product from the product tray to the slicing device.

29. The food processing machine of claim 28 wherein the chute is configured to move the fed, unspooled stock from the chute to a position in which it is disposed underneath and against the food product in a path of the slicing device.

30. The food processing machine of claim 29 wherein the slicing device is configured to slice the food product and the fed, unspooled stock on which the food product is disposed.

31. The food processing machine of claim 30 further comprising at least one conveyor configured to move the food product and the fed, unspooled stock on which the food product is disposed after they are sliced by the slicing device.

* * * * *